US010752414B2

(12) United States Patent
Yang et al.

(10) Patent No.: US 10,752,414 B2
(45) Date of Patent: Aug. 25, 2020

(54) CAN COVER WITH TIME INDICATION FUNCTION

(71) Applicant: ZHUHAI HENGQIN SUPER TECHNOLOGY LTD., Zhuhai, Guangdong (CN)

(72) Inventors: Tianle Yang, Guangdong (CN); Yibao Zeng, Guangdong (CN)

(73) Assignee: ZHUHAI HENGQIN SUPER TECHNOLOGY LTD., Zhuhai (CN)

( * ) Notice: Subject to any disclaimer, the term of this patent is extended or adjusted under 35 U.S.C. 154(b) by 154 days.

(21) Appl. No.: 16/118,403

(22) Filed: Aug. 30, 2018

(65) Prior Publication Data

US 2019/0359397 A1 Nov. 28, 2019

(30) Foreign Application Priority Data

May 23, 2018 (CN) ..... 2018 2 0774230 U

(51) Int. Cl.
*B65D 51/24* (2006.01)
*G09F 19/02* (2006.01)
*G04B 11/02* (2006.01)

(52) U.S. Cl.
CPC ..... *B65D 51/245* (2013.01); *G04B 11/02* (2013.01); *G09F 19/02* (2013.01)

(58) Field of Classification Search
CPC ..... B65D 51/245; G09F 19/02; G04B 11/02; G04B 11/022; G04B 11/024; G04C 23/16
USPC ..... 206/459.1; 116/308, 309, 223, 284, 289, 116/291, 292, 293, 294, 295, 296, 297, 116/DIG. 6, 311, 312, 315
See application file for complete search history.

(56) References Cited

U.S. PATENT DOCUMENTS 2,651,935 A * 9/1953 Able ..... B25B 23/1427 73/1.12
2007/0056503 A1* 3/2007 Sollaccio ..... G09F 11/23 116/308

OTHER PUBLICATIONS

STIC NPL Search, various dates, see attached, compiled date is 2020 (Year: 2020).*

* cited by examiner

*Primary Examiner* — Andrew D Perrault

(57) ABSTRACT

The disclosure provides a can cover with a time indication function, and pertains to the technical field of food containers. The can cover comprises a cover body, and the can cover also comprises an indicating system for indicating the opening date of a can; the indicating system comprises a pointer and a plurality of scale lines; the scale lines are positioned on the surface of the cover body; the pointer is arranged on the surface of the cover body; one end of the pointer can rotate or swing in the range of the scale lines, and points to one of the scale lines. The can cover can indicate the opening date of the can, and assist a user to remember the opening date of the can, so that the opening date of the can can be known clearly, and bad and out-of-date canned food is avoided being eaten.

6 Claims, 7 Drawing Sheets

CAN COVER WITH TIME INDICATION FUNCTION

CROSS REFERENCE TO RELATED APPLICATIONS

The present application claims the benefit of Chinese Patent Application No. 201820774230.7 filed on May 23, 2018. All the above are hereby incorporated by reference.

TECHNICAL FIELD

The disclosure pertains to the technical field of food containers, and relates to a can cover with a time indication function.

BACKGROUND

Along with the growth in the living standard of residents, the number of tourists is constantly increased, the food consumption idea and mode are changing quietly, and many families try to liberate from kitchens so as to reduce the pollution of lampblack and alleviate the load of housework. With the characteristics of convenience, sanitation and easy storage, canned food is applicable for the daily requirement of people, and is welcomed by the people increasingly. However, the storage problem of canned food is involved if the canned foot is not eaten up in one time after being opened, the canned food is easy to get bad after being opened for long time, and if a person forgets the opening date, the health problem is easily caused after the bad canned food is eaten.

SUMMARY

Aiming at the above problem existing in the prior art, the disclosure provides a can cover with a time indication function, and the technical problem to be solved by the disclosure is how to indicate the opening date of a can.

The purpose of the disclosure can be realized through the following technical schemes:

The can cover with the time indication function comprises a cover body, and is characterized in that the can cover also comprises an indicating system for indicating the opening date of the can; the indicating system comprises a pointer and a plurality of scale lines; the scale lines are positioned on the surface of the cover body; the pointer is arranged on the surface of the cover body; one end of the pointer can rotate or swing in the range of the scale lines, and points to one of the scale lines.

The cover body is used for sealing a container filled with canned food, the scale lines are arranged on the surface of the cover body, one scale line stands for one day, one of the scale lines is selected as the starting point of the number of days and is marked with a figure, such as 1, when the pointer points to the scale line marked with one, the time indicates the first day of this month, when the pointer rotates along the clockwise direction, if the pointer points to the next scale line, the indicated time is increased by one day, and so on. Thus, after the can is opened by an operator, the pointer rotates to point to the corresponding scale line according to the date of this month, so that the can cover can indicate the opening date of the can to assist the user to remind the opening date of the can, the opening date of the can can be known clearly, and bad and out-of-date canned food is avoided being eaten.

In the can cover with the time indication function, the cover body is circular, the scale lines are uniformly distributed along the circumferential direction of the cover body, and one end of the pointer is articulated with the middle part of the cover body.

In the can cover with the time indication function, the cover body is square.

In the can cover with the time indication function, the surface of the cover body is provided with a plurality of bar-type ribs, the bar-type ribs are in the shapes of long bars and are uniformly distributed along the circumferential direction of the cover body, the quantity of the scale lines is the same as that of the bar-type ribs, and each scale line is positioned on the surface of the corresponding bar-type rib and extends along the length direction of the corresponding bar-type rib respectively. In the structure, the bar-type ribs are protruded from the surface of the cover body respectively, and thus the user can observe more easily, so that the user can enable the pointer to point to the corresponding date of the scale line more conveniently.

In the can cover with the time indication function, the middle part of the surface of the cover body is provided with a cylindrical boss, the inner end of the pointer is provided with a circular fixed ring, and the fixed ring sleeves the boss and can rotate around the boss.

In the can cover with the time indication function, the outer surface of the boss is provided with a plurality of first teeth, the first teeth are uniformly distributed along the circumferential direction of the boss, the inner wall of the fixed ring is provided with a plurality of second teeth, the second teeth are uniformly distributed along the circumferential direction of the fixed ring, the second teeth are engaged with the first teeth, and the quantity of the first teeth is the same as that of the bar-type ribs. In the structure, the pointer can rotate only under the effect of external force so as to adjust the angle, but the change of the angle is not linear and is discrete, the adjustment is carried out by the pointer pointing to a certain scale line, moreover, the quantity of the first teeth is the same as that of the bar-type ribs, so that the pointer can point to one scale line when the pointer rotates at an angle, and the structure enables the adjustment to be accurate and quick and the hand feeling to be comfortable.

In the can cover with the time indication function, the quantity of the bar-type ribs, the quantity of the first teeth and the quantity of the second teeth are thirty-one respectively. The structure is designed according to thirty-one days in one month, the thirty-one scale lines stand for the first day to the thirty-first day respectively, and the pointer can correspond to one date of this month when pointing to one scale line.

Certainly, as another embodiment, the structure also can be designed according to seven days in one week, so that seven scale lines stand for Monday to Sunday respectively.

In the can cover with the time indication function, the surface of the cover body is marked with FIGS. 1, 5, 10, 15, 20, 25, 30 and 31 along the clockwise direction in sequence respectively, each of the FIGS. 1, 5, 10, 15, 20, 25, 30 and 31 replaces one bar-type rib respectively, there are three bar-type ribs between the FIG. 1 and the FIG. 5, there are four bar-type ribs between the FIG. 5 and the FIG. 10, between the FIG. 10 and the FIG. 15, between the FIG. 15 and the FIG. 20 and between the FIG. 20 and the FIG. 25, the FIG. 30 and the FIG. 31 are arranged adjacently, and the FIG. 31 and the FIG. 1 are arranged adjacently. The structure of the cover body is similar to a dial plate, and after the FIGS. 1, 5, 10, 15, 20, 25, 30 and 31 are marked, the user can determine the date more conveniently, so that the convenience of operation is improved.

In the can cover with the time indication function, the outer surface of the boss is provided with a plurality of first flanges, the first flanges are positioned at the upper end of the boss and are uniformly distributed along the circumferential direction of the boss, the fixed ring is positioned between the first flanges and the surface of the cover body, and the first flanges abut against the upper surface of the fixed ring. The first flanges play a limiting role on the pointer, and can prevent the pointer from being separated from the boss in the rotation process; and moreover, the first flanges also play a guiding role on the pointer, and can prevent the pointer from shaking in the rotation process, so that the stability of the pointer in the rotation process is higher.

In the can cover with the time indication function, the pointer is made of an elastic material. The pointer made of the elastic material is high in flexibility, convenient for angle adjustment and convenient in installation.

In the can cover with the time indication function, the bar-type ribs are positioned on the upper surface of the cover body respectively, the cover body is made of the elastic material, the lower surface of the cover body is provided with a plurality of circular bulge loops, and the inner wall of each bulge loop is provided with a second circular flange respectively. Each bulge loop is used for being matched and fixed with the periphery of a container opening (for example, the bulge loops sleeve the periphery of the container opening, and a container is a container for filing canned food), and the inner diameters of the bulge loops are different, so that the cover body can be applicable for the peripheries of container openings with different calibers; when the inner diameters of the second flanges are slightly smaller than the outer diameter of the periphery of the container opening, the bulge loops sleeve the periphery of the container opening, and the second flanges can be extruded to generate certain elastic deformation, so that the second flanges can be tightly clamped onto the peripheries of the container openings, the structure can increase the firmness, connected with the container for filling the canned food, of the cover body, and the cover body has a preferable sealing effect for the can.

In the can cover with the time indication function, the outer surface of the cover body is provided with a handle, and a through hole is formed in the handle. The cover body can be more convenient for the user to open by applying force to the handle.

Compared with the prior art, the disclosure has the following advantages:

firstly, the can cover can indicate the can opening date, so that the user can avoid from eating expired canned food caused by the fact the user forgets the time of opening the can;

secondly, the cover body made of the elastic material is high in flexibility, convenient for angle adjustment and convenient in installation;

and thirdly, the cover body can be applicable for cans with different calibers, can be repeatedly used, and is scientific and environmentally-friendly.

In the figures, 1, cover body; 1*a*, bar-type rib; 1*b*, boss; 1*b*1, first tooth; 1*b*2, first flange; 1*c*, bulge loop; 1*c*1, second flange; 1*d*, handle; 1*d*1, through hole; 2, pointer; 2*a*, fixed ring; 2*a*1, second tooth; and 3, scale line.

DESCRIPTION OF THE EMBODIMENTS

The technical scheme of the disclosure is further described with reference to the accompanying drawings by specific embodiments of the disclosure, but the disclosure is not restricted by the above-mentioned embodiments.

Figure 1:
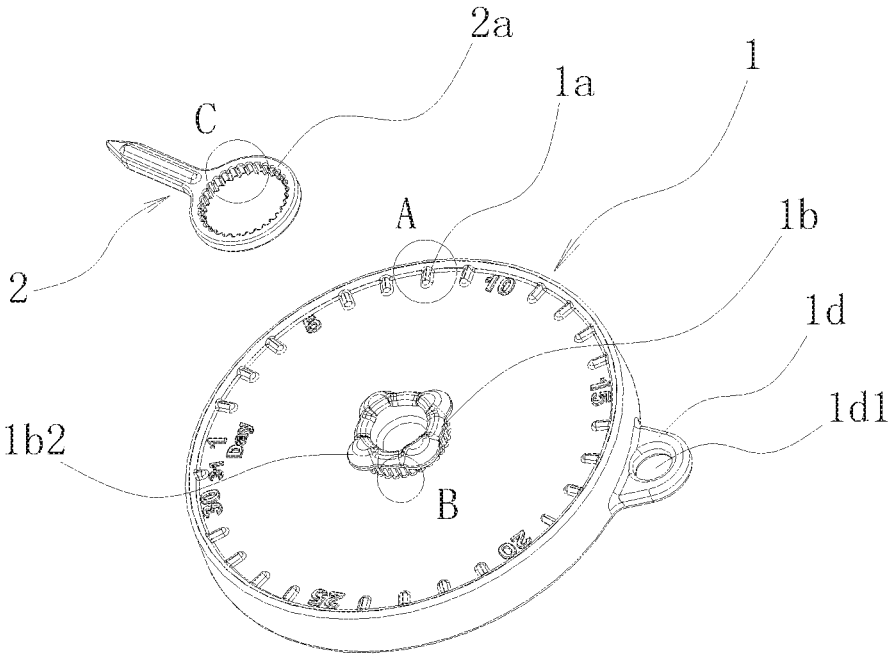
FIG. 1 is an explosive view of the can cover.
Figure 2:
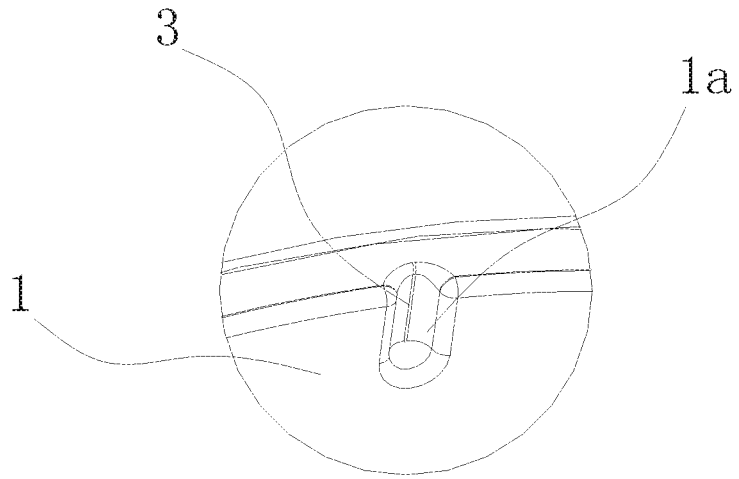
FIG. 2 is an enlarged view of A part in FIG. 1.
Figure 5:
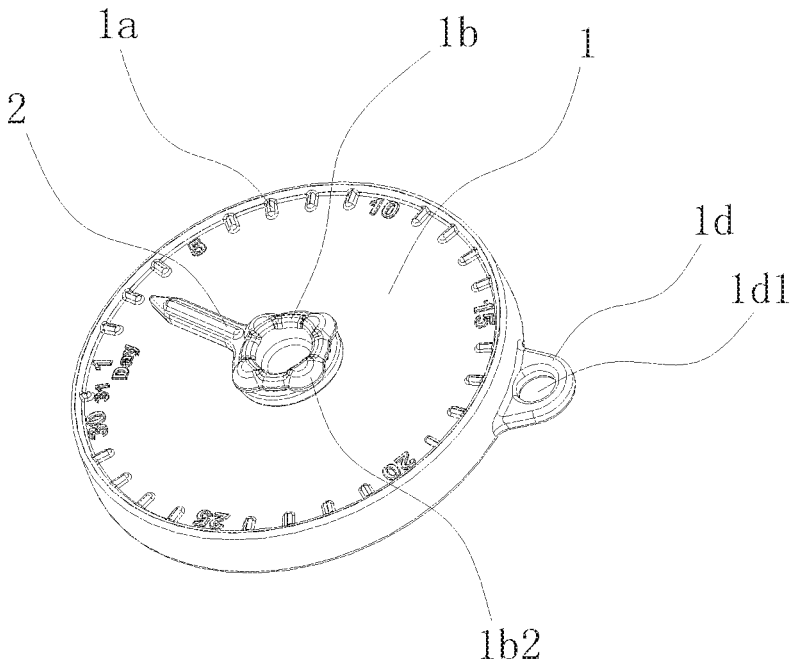
FIG. 5 is an assembly diagram of the can cover.

As shown in FIG. 1, FIG. 2 and FIG. 5, in the embodiment, the can cover comprises a cover body 1, and the cover body 1 is circular; the can cover also comprises an indicating system for indicating the opening date of the can; the indicating system comprises a pointer 2 and a plurality of scale lines 3; the scale lines 3 are positioned on the surface of the cover body 1 and are uniformly distributed along the circumferential direction of the cover body 1; the inner end of the pointer 2 is articulated with the middle part of the cover body 1 and can rotate around the axis of the cover body 1, and the outer end of the pointer 2 faces to the scale lines 3.

As shown in FIG. 1-2, in the embodiment, the surface of the cover body 1 is provided with a plurality of bar-type ribs 1*a*, the bar-type ribs 1*a* are in the shapes of long bars and are uniformly distributed along the circumferential direction of the cover body 1, the quantity of the scale lines 3 is the same as that of the bar-type ribs 1*a*, and each scale line 3 is positioned on the surface of the corresponding bar-type rib 1*a* and extends along the length direction of the corresponding bar-type rib 1*a* respectively. In the structure, the bar-type ribs 1*a* are protruded from the surface of the cover body 1 respectively, and thus the user can observe more easily, so that the user can enable the pointer 2 to point to the corresponding date of the scale line 3 more conveniently.

Figure 7:
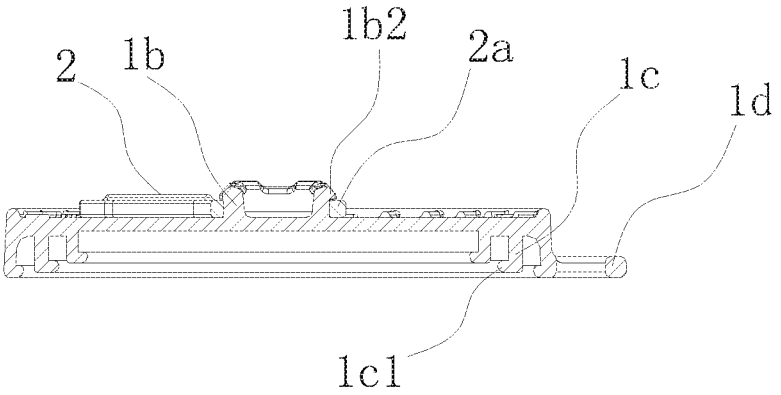
FIG. 7 is a section view of the can cover.

As shown in FIG. 5 and FIG. 7, in the embodiment, the middle part of the surface of the cover body 1 is provided with a cylindrical boss 1*b*, the inner end of the pointer 2 is provided with a circular fixed ring 2*a*, and the fixed ring 2*a* sleeves the boss 1*b* and can rotate around the boss 1*b*.

Figure 3:
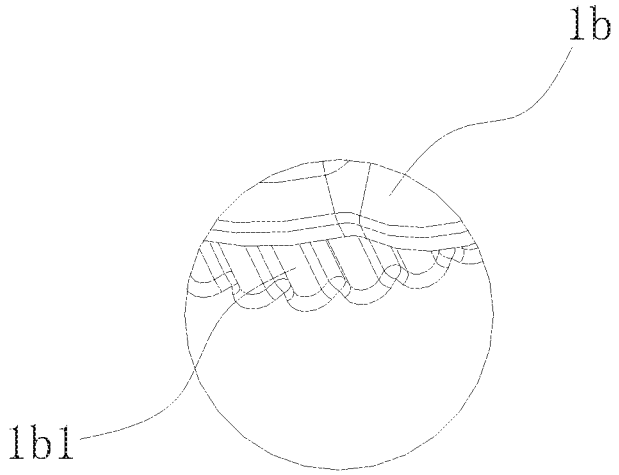
FIG. 3 is an enlarged view of B part in FIG. 1.
Figure 4:
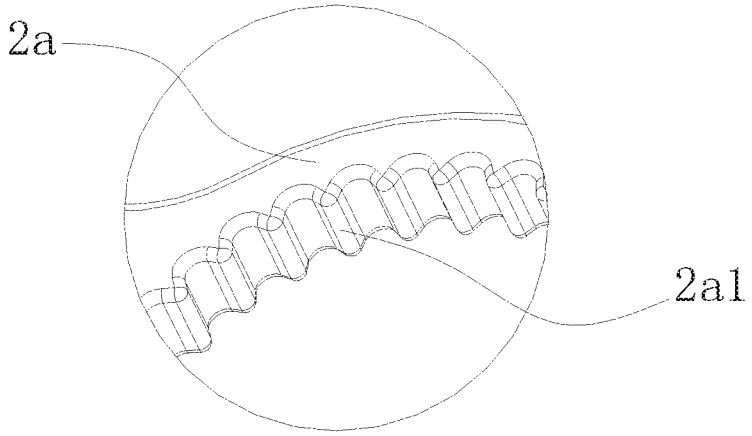
FIG. 4 is an enlarged view of C part in FIG. 1.

As shown in FIG. 1, FIG. 3 and FIG. 4, in the embodiment, the outer surface of the boss 1*b* is provided with a plurality of first teeth 1*b*1, the first teeth 1*b*1 are uniformly distributed along the circumferential direction of the boss 1*b*, the inner wall of the fixed ring 2*a* is provided with a plurality of second teeth 2*a*1, the second teeth 2*a*1 are uniformly distributed along the circumferential direction of the fixed ring 2*a*, the second teeth 2*a*1 are engaged with the first teeth 1*b*1, and the quantity of the first teeth 1*b*1 is the same as that of the bar-type ribs 1*a*. In the structure, the pointer 2 can rotate only under the effect of external force so as to adjust the angle, but the change of the angle is not linear and is discrete, the adjustment is carried out by the pointer 2 pointing to a certain scale line 3, moreover, the quantity of the first teeth 1*b*1 is the same as that of the bar-type ribs 1*a*, so that the pointer 2 can point to one scale line 3 when the pointer 2 rotates at an angle, and the structure enables the adjustment to be accurate and quick and the hand feeling to be comfortable.

Preferably, the quantity of the bar-type ribs 1*a*, the quantity of the first teeth 1*b*1 and the quantity of the second teeth 2*a*1 are thirty-one respectively. The structure is designed according to thirty-one days in one month, the thirty-one scale lines stand for the first day to the thirty-first day respectively, and the pointer 2 can correspond to one date of this month when pointing to one scale line 3.

Certainly, as another embodiment, the structure also can be designed according to seven days in one week, so that seven scale lines 3 stand for Monday to Sunday respectively.

As shown in FIG. 1 or FIG. 5, in the embodiment, the surface of the cover body 1 is marked with FIGS. 1, 5, 10, 15, 20, 25, 30 and 31 along the clockwise direction in sequence respectively, each of the FIGS. 1, 5, 10, 15, 20, 25, 30 and 31 replaces one bar-type rib 1*a* respectively, there are three bar-type ribs 1*a* between the FIG. 1 and the FIG. 5, there are four bar-type ribs 1*a* between the FIG. 5 and the FIG. 10, between the FIG. 10 and the FIG. 15, between the FIG. 15 and the FIG. 20 and between the FIG. 20 and the FIG. 25, the FIG. 30 and the FIG. 31 are arranged adjacently, and the FIG. 31 and the FIG. 1 are arranged adjacently. The structure of the cover body 1 is similar to a dial plate, and after the FIGS. 1, 5, 10, 15, 20, 25, 30 and 31 are marked, the user can determine the date more conveniently, so that the convenience of operation is improved.

As shown in FIG. 1 or FIG. 5, in the embodiment, the outer surface of the boss 1*b* is provided with a plurality of first flanges 1*b*2, the first flanges 1*b*2 are positioned at the upper end of the boss 1*b* and are uniformly distributed along the circumferential direction of the boss 1*b*, the fixed ring 2*a* is positioned between the first flanges 1*b*2 and the surface of the cover body 1, and the first flanges 1*b*2 abut against the upper surface of the fixed ring 2*a*. The first flanges 1*b*2 play a limiting role on the pointer 2, and can prevent the pointer 2 from being separated from the boss 1*b* in the rotation process; and moreover, the first flanges 1*b*2 also play a guiding role on the pointer 2, and can prevent the pointer 2 from shaking in the rotation process, so that the stability of the pointer 2 in the rotation process is higher.

Preferably, the pointer 2 is made of an elastic material. The pointer 2 made of the elastic material is high in flexibility, convenient for angle adjustment and convenient in installation.

Figure 6:
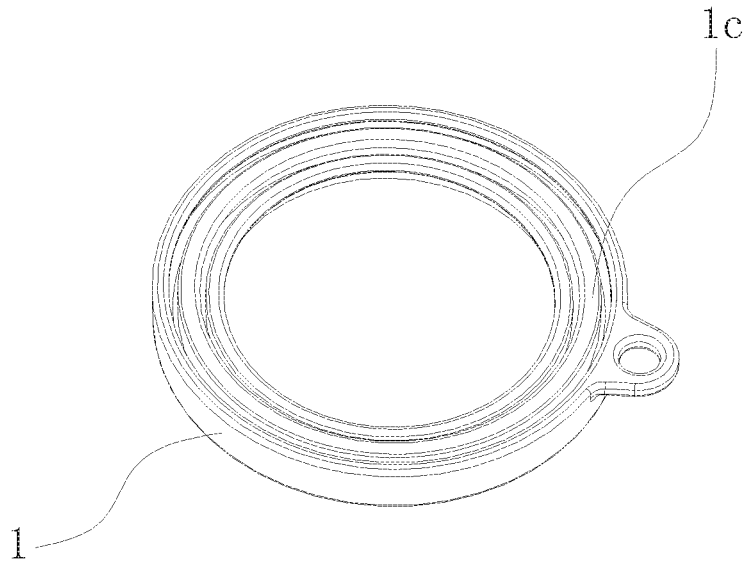
FIG. 6 is a structure diagram of the bottom of the cover body.

As shown in FIG. 5 to FIG. 7, in the embodiment, the bar-type ribs 1*a* are positioned on the upper surface of the cover body 1 respectively, the cover body 1 is made of the elastic material, the lower surface of the cover body 1 is provided with a plurality of circular bulge loops 1*c*, and the inner wall of each bulge loop 1*c* is provided with a second circular flange 1*c*1 respectively. Each bulge loop 1*c* is used for being matched and fixed with the periphery of a container opening (for example, the bulge loops 1*c* sleeve the periphery of the container opening, and a container is a container for filing canned food), and the inner diameters of the bulge loops 1*c* are different, so that the cover body 1 can be applicable for the peripheries of container openings with different calibers; when the inner diameters of the second flanges 1*c*1 are slightly smaller than the outer diameter of the periphery of the container opening, the bulge loops 1*c* sleeve the periphery of the container opening, and the second flanges 1*c*1 can be extruded to generate certain elastic deformation, so that the second flanges can be tightly clamped onto the peripheries of the container openings, the structure can increase the firmness, connected with the container for filling the canned food, of the cover body 1, and the cover body 1 has a preferable sealing effect for the can.

As shown in FIG. 1 or FIG. 5, in the embodiment, the outer surface of the cover body 1 is provided with a handle 1*d*, and a through hole 1*d*1 is formed in the handle 1*d*. The cover body 1 can be more convenient for the user to open by applying force to the handle 1*d*.

The embodiments described in the disclosure are provided for the spirit of the disclosure by way of illustration only. Those skilled in the art can perform various modifications or supplementations for the described embodiments or adopt similar manners to replace, but without departing from the spirit and scope of the disclosure.

What is claimed is:

1. A can cover with a time indication function, comprises a cover body (1), wherein the can cover also comprises an indicating system for indicating the opening date of the can; the indicating system comprises a pointer (2) and a plurality of scale lines (3); the scale lines (3) are positioned on a surface of the cover body (1); the pointer (2) is arranged on the surface of the cover body (1); one end of the pointer (2) can rotate or swing in a range of the scale lines (3), and the end of the pointer (2) points to one of the scale lines (3);

wherein a plurality of bar-type ribs (l*a*) are arranged on the surface of the cover body (1), the bar-shaped ribs (l*a*) are in shapes of long bars and are uniformly distributed along a circumferential direction of the cover body (1), a quantity of the scale lines (3) is same as that of the bar-shaped ribs (l*a*), and each scale line (3) is positioned on a surface of the corresponding bar-shaped rib (l*a*) and extends along a length direction of a corresponding bar-shaped rib (l*a*) respectively;

wherein a middle part of the surface of the cover body (1) is provided with a cylindrical boss (l*b*), an inner end of the pointer (2) is provided with a circular fixed ring (2*a*), and the fixed ring (2*a*) sleeves the boss (l*b*) and is configured to rotate around the boss (l*b*);

wherein an outer surface of the boss (l*b*) is provided with a plurality of first teeth (1*b*1), the first teeth (1*b*1) are uniformly distributed along a circumferential direction of the boss (l*b*), an inner wall of the fixed ring (2*a*) is provided with a plurality of second teeth (2*a*1), the second teeth (2*a*1) are uniformly distributed along a circumferential direction of the fixed ring (2*a*), the second teeth (2*a*1) are engaged with the first teeth (1*b*1), and a quantity of the first teeth (1*b*1) is same as that of the bar-type ribs (l*a*);

wherein a quantity of the bar-shaped ribs (l*a*), the quantity of the first teeth (1*b*1) and a quantity of the second teeth (2*a*1) are thirty-one respectively;

wherein the outer surface of the boss (l*b*) is provided with a plurality of first flanges (1*b*2), the first flanges (1*b*2) are positioned at an upper end of the boss (l*b*) and are uniformly distributed along the circumferential direction of the boss (l*b*), the fixed ring (2*a*) is positioned between the first flanges (1*b*2) and the surface of the cover body (1), and the first flanges (1*b*2) abut against an upper surface of the fixed ring (2*a*).

2. The can cover with the time indication function according to claim 1, wherein the cover body (1) is circular, the scale lines (3) are uniformly distributed along the circumferential direction of the cover body, and one end of the pointer (2) is articulated with the middle part of the cover body (1).

3. The can cover with the time indication function according to claim 1, wherein the cover body (1) is square.

4. The can cover with the time indication function according to claim 1, wherein the pointer (2) is made of an elastic material.

5. The can cover with the time indication function according to claim 1, wherein the bar-shaped ribs (l*a*) are positioned on an upper surface of the cover body (1) respectively, the cover body (1) is made of an elastic material, a lower surface of the cover body (1) is provided with a plurality of circular bulge loops (1*c*), and an inner wall of each of the circular bulge loop (1*c*) is provided with a second flange (l*c*1) that is circular-shaped.

6. The can cover with the time indication function according to claim 1, wherein an outer surface of the cover body (1) is provided with a handle (1*d*), and a through hole (l*d*1) is formed in the handle (1*d*).

* * * * *